United States Patent [19]

Ford

[11] Patent Number: 4,762,159

[45] Date of Patent: Aug. 9, 1988

[54] SHADE SYSTEM

[75] Inventor: Alan A. Ford, Sturgis, Mich.

[73] Assignee: Cooper Industries, Houston, Tex.

[21] Appl. No.: 908,860

[22] Filed: Sep. 18, 1986

[51] Int. Cl.[4] ..... E06B 9/262

[52] U.S. Cl. ..... 160/84.1; 160/279

[58] Field of Search ..... 160/84 R, 279, 172, 160/166 R, 321, 322

[56] References Cited

U.S. PATENT DOCUMENTS

| | | | |
|---|---|---|---|
| 1,591,104 | 7/1926 | Robinson | 160/321 X |
| 2,247,260 | 6/1941 | Stone | 160/84 R |
| 2,269,579 | 1/1942 | Chilton | 160/107 X |
| 2,328,305 | 8/1943 | Stefano | 160/172 X |
| 3,465,806 | 9/1969 | Sulkes | 160/84 R |
| 4,202,395 | 5/1980 | Heck et al. | 160/279 X |
| 4,473,101 | 9/1984 | Langeler | 160/84 R |
| 4,557,309 | 12/1985 | Judkins | 160/84 R |
| 4,593,737 | 6/1986 | Clemente | 160/84 R |
| 4,647,488 | 3/1987 | Schnebly et al. | 160/84 R X |
| 4,673,018 | 6/1987 | Judkins | 160/84 R |
| 4,679,610 | 7/1987 | Spraggins | 160/84 R X |
| 4,694,877 | 9/1987 | Dunbar | 160/84 R X |

FOREIGN PATENT DOCUMENTS

| | | | |
|---|---|---|---|
| 0096518 | 12/1983 | European Pat. Off. | 160/166 R |

*Primary Examiner*—Ramon S. Britts
*Assistant Examiner*—David M. Purol
*Attorney, Agent, or Firm*—Eddie E. Scott; Alan R. Thiele

[57] ABSTRACT

A shade system includes a fixed top rail, a fixed bottom rail and a movable middle rail. A shade is affixed between the top rail and the middle rail and is folded when the middle rail is moved with respect to the top rail by a continuous loop drive system. The shade system of the present invention may be used with any window irrespective of the orientation of the window.

11 Claims, 2 Drawing Sheets

SHADE SYSTEM

BACKGROUND OF THE INVENTION

The present invention relates to window coverings, more specifically, the present invention relates to window covering for skylights and the like.

The use of skylights or non-vertical windows has become extremely popular in recent years. Such skylights or non-vertical windows often form an essential part of an atrium setting in a residence or a business. While skylights or non-vertical windows provide increased natural light they also allow direct sunlight to pass into a room during certain portions of the day. This direct sunlight is hot and often uncomfortable. There is therefore a need in the art to provide a window covering device for skylights or non-vertical windows which will block out the rays of the sun when desired.

Conventional window shades or blinds are not acceptable as they depend on gravity for operation. Accordingly, they are only operable with vertical windows. The covering for a skylight or non-vertical window must be operable irrespective of the orientation of the window therefore it must not depend on gravity for its operation.

While the use of shades over skylights or non-vertical windows is not a new concept, prior art devices have had two drawbacks. First, the prior art devices typically have required the use of side rails to stabilize the screen or blinds. The use of side rails markedly increases the complexity of the device. Second, prior art devices typically employ a linear cord pull drive system, such as found on residential venetian blinds, to move the window covering. When employed on skylights or non-vertical windows the cord in such a linear cord pull drive system hangs away from the window and becomes inconvenient, unattractive or possibly even hazardous.

Exemplary of prior art attempts to provide covering for skylights or non-vertical windows are U.S. Pat. No. 4,473,101 to Langeler and U.S. Pat. No. 2,328,305 to De Stefano. It will be noted that both of these references teach the use of side rails for proper operation of the shade device. Such side rails greatly add to the complexity of the device and are inconvenient to service, particularly, when the shade device is mounted high on a ceiling or on a slanted top portion of a wall.

There is therefore a need in the art to provide a shade system which may be used with skylights or non-vertical windows that does not depend on gravity for operation, that does not require the use of side rails or that does not require a linear cord pull drive system for proper operation.

SUMMARY OF THE INVENTION

According to the concepts embodied in the present invention a shade system is provided which does not require the use of gravity, the use of side rails or the use of a linear cord pull drive system for proper operation.

The shade system of the present invention for a skylight or non-vertical window has substantially parallel first rail and second rails which span the width of the window. The first rail and the second rail are fixed to either side of the window or built into the window frame. Situated between the first and second rails is a middle rail which also spans the width of the window. The middle rail is generally parallel to the first and second rails and is movable with respect to the first and second rails irrespective of the orientation of the first and second rails. It is this movability that permits use on a skylight or non-vertical window.

Attached to the middle rails and the first rail is a shade fabric. In a preferred embodiment the shade fabric is folded into pleats so that when the middle rail is moved toward the first rail and away from the second rail, the pleats will lie one on top of another to neatly stack the shade fabric.

The shade system of the present invention also includes an internal pulley and cord arrangement to permit the middle rail to be moved with respect to the first and second rails. The pulley and cord arrangement has a cord tensioner and drive wheel in its preferred embodiment. The cord tensioner and drive wheel enable the movement of the middle rail irrespective of the vertical orientation of the shade system. Accordingly, the shade system of the present invention may be used on a vertical window, a horizontal skylight or any type of window or the like irrespective of the angle of mounting of the window frame as it does not depend on gravity for its operation.

BRIEF DESCRIPTION OF THE DRAWINGS

A further understanding of the shade system of the present invention may be had by reference to the Figures wherein.

DETAILED DESCRIPTION OF THE EMBODIMENTS

Figure 1:
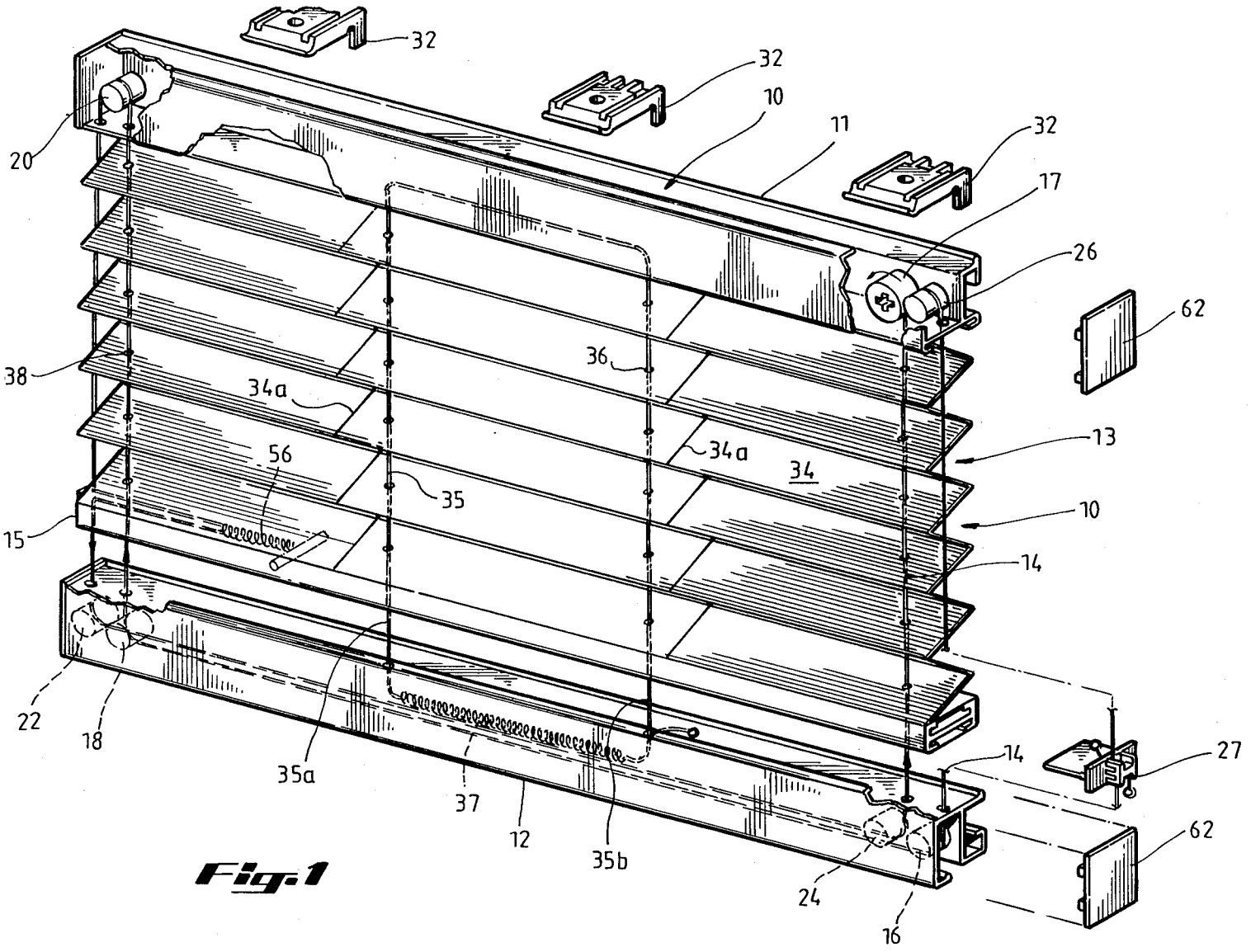
FIG. 1 is a perspective view in partial section of the shade system of the present invention.
Figure 2:
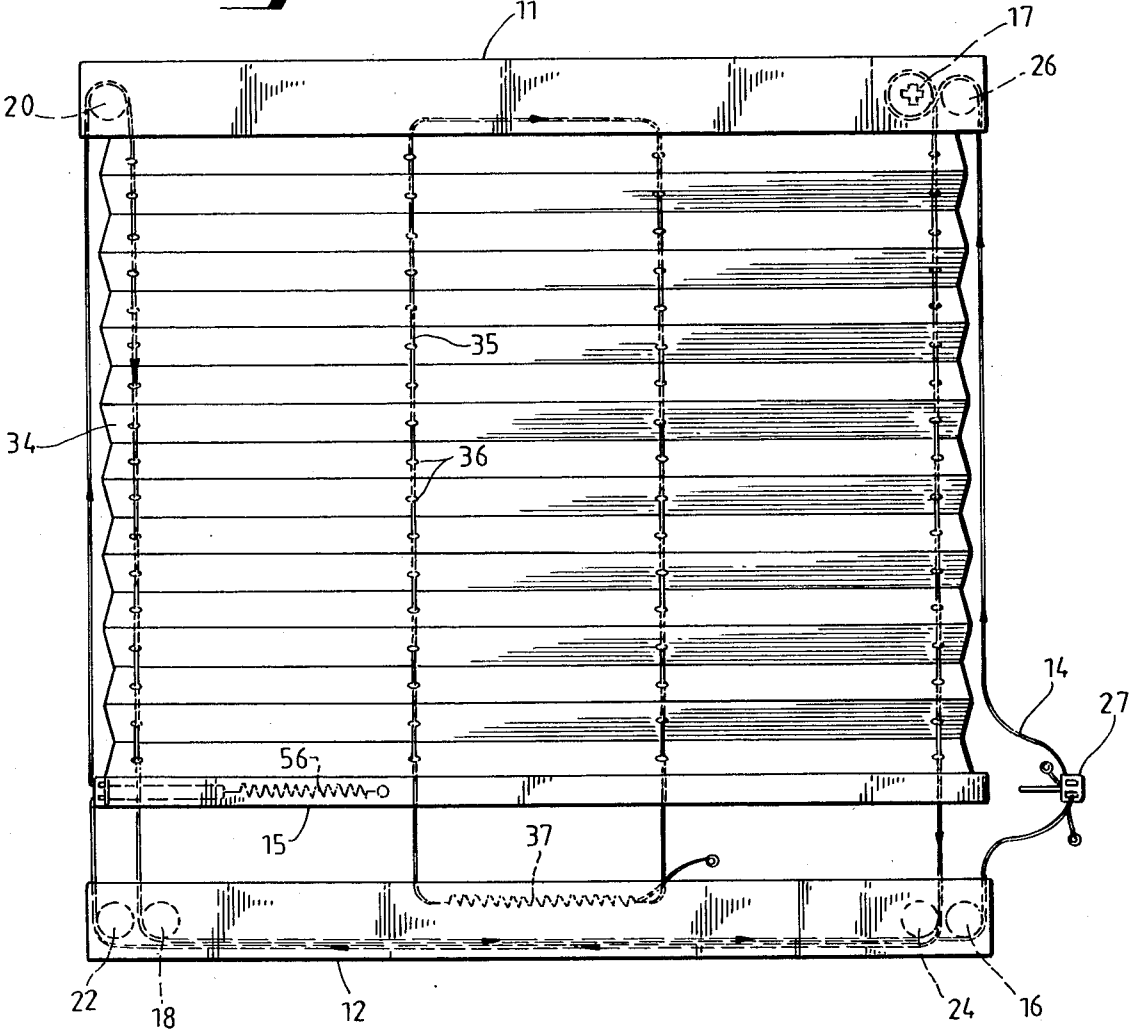
FIG. 2 is a front elevational view of the shade system of FIG. 1 with the end cap in position for adjustment.

As may be seen by reference to FIGS. 1 and 2 the shade system 10 of the present invention includes a first rail 11 and a second rail 12. First rail 11 and second rail 12 are generally parallel to one another and may be affixed to a window or skylight frame (not shown) at either end of the frame or on either side of the frame. Brackets 32 are exemplary of the type of hardware which may be used to mount shade system 10 to a window frame. It will be understood that a plurality of brackets 32 may be used on first rail 11 and second rail 12. The number of brackets 32 employed is dependent on the width of the shade system. While brackets 32 are shown in the preferred embodiment, it will be understood that other suitable attachment means may be used without falling outside the scope of the present invention.

Situated between first rail 11 and second rail 12 and generally parallel thereto is movable middle rail 15. Shade fabric 34 may be affixed to first rail 11 and middle rail 15 by any convenient means such as glue, tracks or nails. In the preferred embodiment, fabric 34 is shown affixed to first rail 11; however, it may be affixed to second rail 12 instead of first rail 11 without affecting the operability of system 10.

In the midst of central portion of shade fabric 34 is located a taught loop designated herein by reference number 35. Loop 35 is positioned between first rail 11 and second rail 12 so as to pass through openings 36 formed in shade fabric 34. Tension is maintained on loop 35 by a spring bias device 37 which may be mounted within either first rail 11 or second rail 12. While not part of the drive system the sides of loop 35 both guide and prevent drooping of shade fabric 34 where system 10 is used on large windows. If desired, extensible rods may be used in the place of taught cord 35*a* and 35*b*.

Figure 3A:
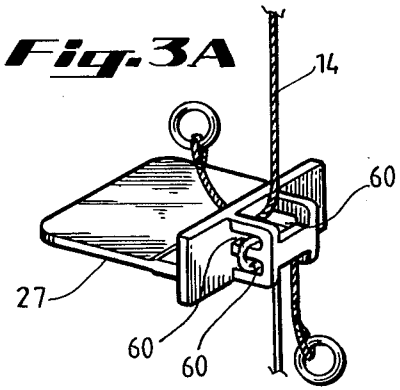
FIG. 3A is a perspective view from above of the end cap.
Figure 3B:
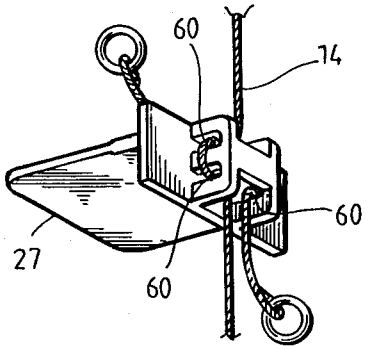
FIG. 3B is a perspective view from below of the end cap.

Cord and pulley arrangement, generally 13, is supported within first rail 11 and second rail 12 by pulleys 16, 18, 20, 22, 24 and 26 located at the four corners of the system 10. Cord 14 forms a continuous loop around the perimeter of shade system 10 by passing through openings 38 at the ends of shade fabric 34. As shown in FIGS. 3A and 3B, the two ends of cord 14 are looped through openings 60 in end cap 27 in a manner which allows for tension adjustment. Such adjustment is accomplished by passing cord 14 through a tortuous path formed in end cap 27. It is used for the three rail system and the continuous loop cord and pulley arrangement 13 as shown which permits fabric 34 to be extended over or retracted from covering a window opening without the use of side rails.

The continuous loop formed by cord 14 is attached on one end of middle rail 15 in a manner which allows for tension adjustment of cord 14 which supports and moves middle rail 15. Within the other end of middle rail 15 is a tensioning spring 56 to allow for selective positioning of middle rail 15 with respect to first rail 11 and second rail 12. Such mounting of middle rail 15 allows traverse cord 14 to remain tensioned throughout the entire length of travel of middle rail 15 and also allows for stretch and shrinkage of cord 14. Traverse cord 14 is routed around drive wheel 17 positioned in either first rail 11 or second rail 12. When drive wheel 17 is turned the entire traverse cord 14 moves around the perimeter of the shade system 10. This movement of cord 14 causes fabric 34 to move to the position desired. The use of a drive wheel 17 eliminates the inconvenience of a linear cord pull drive system.

Shade fabric 34 may be formed from a single piece of cloth or made in sections as shown by the seam lines 34*a* and 34*b* in FIG. 1. Rails 11, 12 and 15 may be formed of aluminum, plastic or any suitable conveniently formed construction material. Rails 11 and 12 can be formed in channel shapes or any other convenient shape to mask pulley and cord arrangement 13. End covers 62 can be added for a decorative appearance. Middle rail 15 may be of any convenient shape which permits the mounting of tensioning spring 56 either within or on the surface of rail 15. One end of spring 56 is affixed to the middle rail 15 and the other end of the spring 56 engages the cord 14 by trapping it between the coils of spring 56 so that excessive force can release cord 14 and allow it to slide through the spring coils and change the point spring 56 engages cord 14. Cord and pulley arrangement 13 may be actuated by a crank (not shown) or may be motorized. Motorization, if desired, may be controlled by hard wiring or a radio transmitting and receiving system.

There is now provided by the shade system of the present invention a convenient, easy-to-use cover for a skylight or the like which does not require the use of gravity, the use of side rails or the use of a linear cord pull drive system.

While the shade system of the present invention is described with reference to the preferred embodiment it will be understood that further variations or modifications of the shade system of the present invention may become apparent to those skilled in the art. Such variations or modifications shall fall within the coverage of the appended claims.

What is claimed is:

1. A shade system for a window comprising:

a fixed first rail;

a fixed second rail;

a movable middle rail, said movable middle rail being positionable with respect to said fixed first rail and said fixed second rail;

a shade fabric affixed to said fixed first rail and said movable middle rail;

a cord constructed and arranged to move substantially around the perimeter of the shade system by passing over a plurality of pulleys;

a spring tensioner within said middle rail, said spring tensioner having a first portion attached to said middle rail and a second portion releasably connected to said cord;

a rotatable drive member constructed and arranged to move said cord around said pulleys;

whereby rotation of said rotatable drive member causes said cord to move substantially around the perimeter of said shade system over said pulleys which in turn causes said movable middle rail to be positioned with respect to said fixed first rail and said fixed second rail.

2. The shade system as defined in claim 1 wherein said drive wheel is located in said fixed first rail.

3. The shade system as defined in claim 1 further including means for preventing drooping of said shade fabric located in the center portion of said shade fabric.

4. The shade system as defined in claim 3 wherein said means for preventing drooping of said shade fabric are holes formed in said shade fabric and guide means extending between said fixed first and said fixed second rails, said guide means constructed and arranged to fit with said holes in said shade fabric.

5. The shade system as defined in claim 1 wherein said fixed first rail and said fixed second rail are retained in position by at least one bracket.

6. The shade system as defined in claim 1 wherein said fixed first rail and said fixed second rail are substantially channel shaped members.

7. The shade system as defined in claim 6 wherein said fixed first rail and said fixed second rail are constructed and arranged to conceal the means for moving said movable middle rail with respect to said fixed first rail.

8. The shade system as defined in claim 1 wherein said shade fabric is folded into pleats.

9. A shade system comprising:

a fixed first rail;

a fixed second rail;

a movable middle rail, said movable middle rail being positionable with respect to said fixed first rail and said fixed second rail;

a foldable shade fabric affixed to said first rail and said movable middle rail;

a cord constructed and arranged to move substantially around the perimeter of the shade system by passing over a plurality of pulleys, said pulleys being positioned substantially at the corners of said shade system;

a spring tensioner within said middle rail, said spring tensioner having a first portion attached to said middle rail and a second portion releasably connected to said cord;

a rotatable drive member constructed and arranged to move said cord over said pulleys;

whereby rotation of said rotatable drive member causes said cord to move substantially around the perimeter of said shade system which in turn causes said movable middle rail to be positioned with respect to said fixed first rail and said fixed second rail and said shade fabric may be folded or unfolded irrespective of the orientation of the shade system.

10. The shade system as defined in claim 9 wherein: said drive wheel is located in said fixed first rail.

11. A method for providing a shade system on a non-vertical window or the like, said method comprising the steps of:

placing a fixed first rail and a fixed second rail on the top and bottom respectively of the non-vertical window or the like;

selecting a foldable shade fabric of a size sufficient to cover the non-vertical window or the like;

affixing said shade fabric to said first rail and a movable middle rail;

employing a non-gravity dependent cord system constructed and arranged to move substantially around the perimeter of the shade system on a plurality of pulleys positioned substantially at the corners of said shade system and tensioned with respect thereto by a spring tensioner located within said middle rail and caused to move by a rotatable drive member, said spring tensioner having a first portion attached to said middle rail and a second portion releasably connected to said cord.

* * * * *